US005926929A

United States Patent [19]

MacKirdy

[11] Patent Number: 5,926,929

[45] Date of Patent: Jul. 27, 1999

[54] VENTING SYSTEM FOR ABOVE GROUND CASKET

[75] Inventor: William T. MacKirdy, Scott Run, Pa.

[73] Assignee: Casket Shells, Incorporated, Eynon, Pa.

[21] Appl. No.: 08/683,569

[22] Filed: Jul. 15, 1996

[51] Int. Cl.[6] ..... A61G 17/02

[52] U.S. Cl. ..... 27/2; 27/11

[58] Field of Search ..... 27/2, 3, 5, 6, 7, 27/35; 137/539, 540

[56] References Cited

U.S. PATENT DOCUMENTS

| | | | |
|---|---|---|---|
| 2,655,714 | 10/1953 | Rench | 27/35 |
| 2,665,471 | 1/1954 | Gould | 27/35 |
| 2,707,965 | 5/1955 | Allen | 137/539 |
| 3,343,564 | 9/1967 | Peeples et al. | 137/539 |
| 4,700,741 | 10/1987 | Murphy | 137/539 X |
| 4,924,565 | 5/1990 | Rathjen | 27/7 |
| 5,558,121 | 9/1996 | Webster et al. | 137/359 X |

*Primary Examiner*—Kien T. Nguyen

*Attorney, Agent, or Firm*—Kane, Dalsimer, Sullivan, Kurucz, Levy, Eisele and Richard, LLP

[57] ABSTRACT

A one-way valve is mounted on a wall of a casket for venting gas and vapor pressure build up interiorly of the casket incident to body decomposition.

4 Claims, 1 Drawing Sheet

VENTING SYSTEM FOR ABOVE GROUND CASKET

BACKGROUND OF THE INVENTION

The use of metal caskets possessing a gasketed seal for the lid to the casket body has become increasingly popular for above ground entombment (mausoleum). However, studies have shown that the forces at work during body decomposition in mausoleum entombments are so powerful that relatively high internal gas and vapor pressures develop with time. This pressure will eventually become so severe that rupture will occur at the weakest location forcing fluids and liquids out of the casket onto the mausoleum floor. This is aggravated by the formation of droplets on the metal itself that results from condensation of moisture vapor that takes place at night when temperatures drop to low levels.

Some manufacturers simply rely on the gas pressure build up to "burp" or vent at a weak spot around the gasket. The problem with this approach is that the gasket may be forced out of location and position by compromising if not destroying the integrity of the seal.

SUMMARY OF THE INVENTION

A principal object of the present invention is to provide a relief system for venting excess gas or vapor pressure that may develop internally of a casket.

Another object is to provide a relief system of the foregoing type that will reseal itself once the pressure has been vented thereby ensuring the casket protective integrity particularly from outside grave site substances.

A further object is to provide a one-way relief system of the foregoing type that assures that as pressure and destructive vapors leave the casket, they and other grave site substances can not migrate back into the casket.

Still another object is to provide a relief system of the foregoing type in which a relief valve is incorporated into the end crank cap thereby eliminating the need to punch another hole into the shell of the casket.

Other objects and advantages will become apparent from the following detailed description which is to be taken in conjunction with the accompanying drawings.

DETAILED DESCRIPTION

Figure 1:
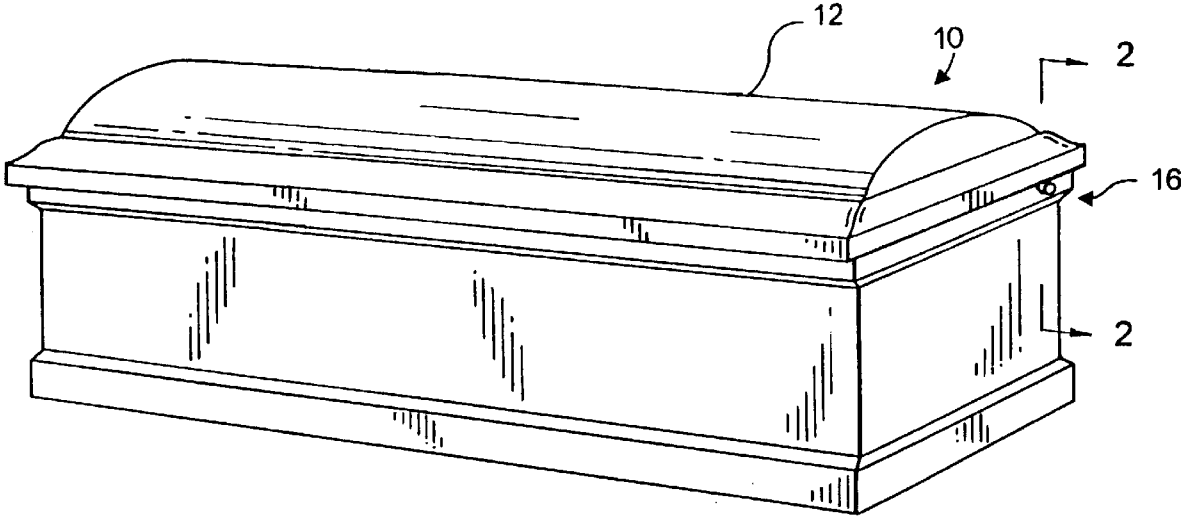
FIG. 1 is a perspective view of a casket incorporating a relief system according to the teachings of this invention.
Figure 2:
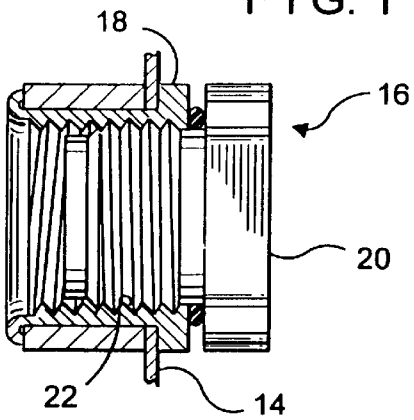
FIG. 2 is a fragmentary cross-sectional view taken along the line 2—2 of FIG. 1.
Figure 3:
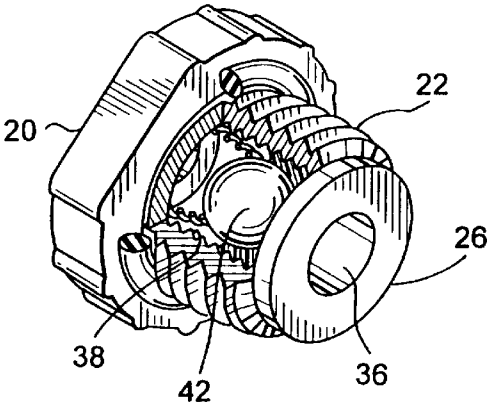
FIG. 3 is a perspective view of the relief valve with certain parts broken away and removed.
Figure 4:
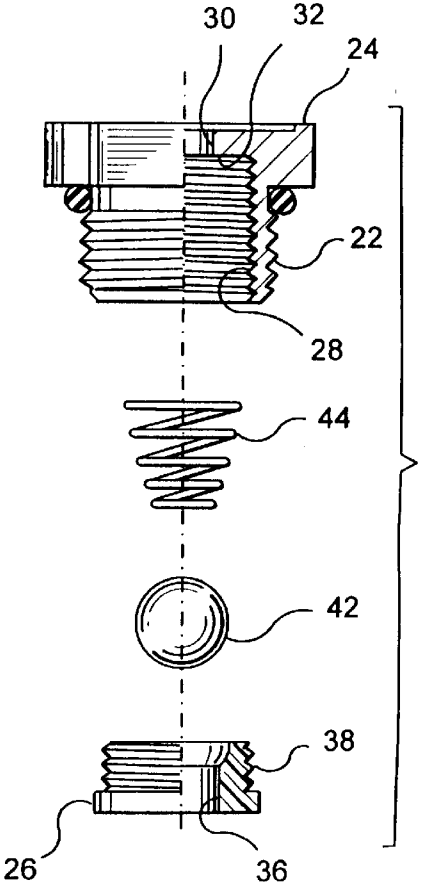
FIG. 4 is an exploded view of the parts of the relief valve with certain parts partially in section.

Referring now to the drawings, a stamped metal casket 10 is shown with a closed lid 12, sealed to the body 14 by a gasket (not shown). While the casket is shown somewhat schematically, it should be understood that caskets of many other types and styles and materials may adapt the teachings of the present invention.

In accordance with this invention, a pressure and vapor relief system 16 is incorporated into the casket 10 and preferably into the end crank cap. In this regard, a tapped plug 18 is suitably secured or anchored to the wall of body 14 in a suitably sealed manner. One-way relief valve 20 is provided with external threads 22 which mate with the internal threads of the tapped plug 18. The valve 20 includes a rear housing member 24 that has external threads 22 and a front housing plug member 26 preferably of rigid yet somewhat elastic plastic.

Rear housing member 24 is provided with internal threads 28 and a through central opening 30 surrounded by internal shoulder 32. An O-ring 34 serves to create a seal between the rear housing member 24 and, consequently, the valve 20 and the tapped plug 18.

The front housing member 26 also includes a through axial opening 36 and external threads 38 that mesh with the internal threads 28 of rear housing member 24 in a sealed fashion. A valve seat 40 is also advantageously formed internally of the front housing plug member 26.

The valve seat 40 conveniently receives ball valve member 42 under the bias of spring 44 which engages the ball valve member 42 at one end and shoulder 32 of rear housing member 24. The seating of ball valve member 42 on valve seat 40 closes off the opening 36 and consequently the passageway through the valve 20. When pressure builds up within the casket 10 from body decomposition, preferably as low as 1½ lbs/per square inch, the ball valve member 42 will unseal from valve seat 40 against the bias of spring 44 to vent to atmosphere the internal pressure and vapor pressure without danger of body fluids being forced exteriorly of the casket.

Thus, the several aforenoted objects and advantages are most effectively attained. Although a single somewhat preferred embodiment has been disclosed and described in detail herein, it should be understood that this invention is in no sense limited thereby and its scope is to be determined by that of the appended claims.

I claim:

1. A casket comprising a body and lid defining a casket interior for a decomposing body that is adapted to generate gas and vapor pressure in the interior of the casket as a result of the decomposing body, a relief valve, means for securing the relief valve on the casket for relieving gas and vapor pressure build up in the interior of the casket as a result of the decomposing body, the valve having a passageway therethrough for communicating the interior of the casket with atmosphere, the valve comprising a valve seat and a valve member seating on the valve seat and a biasing means for biasing the valve member on the valve seat, the valve including a housing having a rear housing member and a front housing plug member defining the passageway, the rear housing member having internal threads and the front housing plug member having external threads mating with the internal threads of the rear housing member, the front housing plug member having the valve seat and being formed from a rigid but elastic resin for sealing the mating threads and the valve member seating on the valve seat, the valve member being a ball, the biasing means being spring biased directly against the ball and internal surfaces of the rear housing member, and when the gas and vapor pressure in the interior of the casket reaches a predetermined level, the valve member will automatically unseat from the valve seat against the bias of the biasing means to relieve the gas and vapor pressure to the atmosphere.

2. The invention in accordance with claim 1 wherein the lid is sealed to the casket body.

3. The invention in accordance with claim 1 wherein the securing means is a tapped plug for receiving the valve.

4. The invention in accordance with claim 3 wherein an O-ring is on the exterior of the rear housing member for sealing the valve to the tapped plug.

* * * * *